US010011126B2

(12) United States Patent
Montagutelli

(10) Patent No.: US 10,011,126 B2
(45) Date of Patent: Jul. 3, 2018

(54) PRINTER READY TO PRINT DETECTION SYSTEM FOR A THERMAL PRINTING MECHANISM

(71) Applicant: APS TRADING OOD, Botevgrad (BG)

(72) Inventor: Denis Montagutelli, Angers (FR)

(73) Assignee: APS TRADING OOD, Botevgrad (BG)

( * ) Notice: Subject to any disclaimer, the term of this patent is extended or adjusted under 35 U.S.C. 154(b) by 0 days.

(21) Appl. No.: 15/564,643

(22) PCT Filed: May 10, 2016

(86) PCT No.: PCT/EP2016/060409
§ 371 (c)(1),
(2) Date: Oct. 5, 2017

(87) PCT Pub. No.: WO2016/184722
PCT Pub. Date: Nov. 24, 2016

(65) Prior Publication Data

US 2018/0079230 A1 Mar. 22, 2018

(30) Foreign Application Priority Data

May 19, 2015 (EP) ..... 15168282

(51) Int. Cl.
*B41J 11/14* (2006.01)
*B41J 11/04* (2006.01)
*B41J 2/32* (2006.01)

(52) U.S. Cl.
CPC ..... *B41J 11/14* (2013.01); *B41J 2/32* (2013.01); *B41J 11/04* (2013.01)

(58) Field of Classification Search
None
See application file for complete search history.

(56) References Cited

U.S. PATENT DOCUMENTS 5,779,371 A * 7/1998 Aoyama ..... B41J 25/34 347/197
2006/0291933 A1 12/2006 Watanabe et al.

FOREIGN PATENT DOCUMENTS

FR 2786727 B1 6/2001
JP 2008037051 A 2/2008

OTHER PUBLICATIONS

International Search Report and Written Opinion of the International Searching Authority for Application No. PCT/EP2016/060409, dated Jul. 4, 2016.

* cited by examiner

*Primary Examiner* — Lisa M Solomon
(74) *Attorney, Agent, or Firm* — Marshall, Gerstein & Borun LLP

(57) ABSTRACT

Thermal print mechanism comprising a printer chassis, a thermal printhead, a platen roller having a conductive shaft, a manner of imparting motion to put the platen roller in rotation, two lateral conductive contacts arranged on the printer chassis so as to be directly or indirectly in electrical contact with two opposite ends of the platen roller conductive shaft for conducting of electrical current, thus forming an electrical switch. At least one nonconductive part of one end of the conductive shaft interacting with one two lateral conductive contact or at least one nonconductive element mounted on said one end of the conductive shaft, is arranged so as to open and to close the switch when the platen roller is rotating.

15 Claims, 6 Drawing Sheets

PRINTER READY TO PRINT DETECTION SYSTEM FOR A THERMAL PRINTING MECHANISM

CROSS REFERENCE TO RELATED APPLICATION

The present application is the US national phase of International Application No. PCT/EP2016/060409, filed May 10, 2016, which claims priority to European Patent Application No. 15168282.0, filed May 19, 2015. The priority application, EP 15168282.0, is hereby incorporated by reference.

TECHNICAL FIELD OF THE INVENTION

The invention relates to a thermal printing mechanism.

PRIOR ART

Direct thermal printer is a widely used printing technology. A thermal printing mechanism usually comprises a chassis for holding all of the following components: a thermal printhead, a platen roller that can be put in rotation by a motor through a gear train, and pressure means in order to keep under pressure the thermal printhead against the platen roller. A thermal sensitive paper is inserted between the platen roller and the thermal printhead, and the printout is generated by combining the paper advance with the dot selection and activation on the thermal printhead.

An improvement of such device is providing the possibility to separate the platen roller from the thermal printhead and the chassis in order to facilitate the loading of the paper and its positioning between the thermal printhead and the platen roller. In such arrangement the platen roller has two positions: first one called the printing position, where the platen roller is held in the printer chassis and allows the printer to print, and second one—called open position wherein the platen roller is detached from the printer chassis. Such arrangements of a thermal print mechanism are well known in the prior art, and described for example in FR2786727.

In addition such devices can comprise also a sensor on the printer chassis to sense the presence of the paper. Such sensor is in most of the cases an optical reflective sensor, and in some specific cases a transmittive sensor or a microswitch. Such sensor can also be used to detect the separation of the platen roller out of the printer chassis, when the thermal printer having an easy loading system.

This last detection is not very reliable. In particular it is based on the fact that when the platen roller is in the printing position, the combination of its position with the paper guide which guides the paper into the printer mechanism and also holds the optical sensor, forces the paper to make a <<S>> shape curve. Then, when the platen roller is detached and moved away from the printer chassis, the paper tends to go back in a straight shape, thus increasing its distance from the optical sensor.

Such detection system requires an analog to digital conversion on the electronic board, moreover since the optical sensor has an important gain variation from one to another, a calibration procedure has to be done on the electronic board which measures the electrical signal coming out form the optical sensor, making this detection complex to setup and operate and not always reliable.

Using such sensors increase the overall dimensions and production costs of the thermal printer mechanism that presently have become more and more important requirements for such devices.

SUMMARY OF THE INVENTION

The aim of the present invention is to simplify the printer construction by avoiding such optical sensor while providing the means to detect the printer availability to print using usual parts of the thermal printing mechanism. The solution of the present invention applies indifferently for mechanism having the removable platen roller (easy-loading system) or not. This would allow keeping the overall dimensions in a desired range, simplifying the construction using fewer components and thus decreasing production costs of the device. As it will become clear from the following description the present invention adds extra functions to the thermal printer mechanism. The present invention proposes a solution by using the platen roller itself to detect the printer availability to print.

The above mentioned aim is achieved by the thermal printing mechanism comprising:

- a printer chassis,
- a thermal printhead,
- a platen roller having a conductive shaft
- motion means to put the platen roller in rotation trough a platen roller gear fixedly mounted on one end of the platen roller conductive shaft and
- two lateral conductive contacts arranged on the printer chassis so as to be directly or indirectly in electrical contact with two opposite ends of the platen roller conductive shaft for conducting of electrical current, thus forming an electrical switch.

According to the present invention on one of the ends of the conductive shaft interacting with one of the lateral conductive contacts there is at least one nonconductive part that is integral with said one end of the conductive shaft or there is at least one nonconductive element fixedly mounted on said one end of the conductive shaft, said at least one non conductive part or said at least one nonconductive element being arranged at contact area of said one end of the conductive shaft so as that during rotation of the platen roller the respective lateral conductive contact being able to successively interact with the conductive part of said end of the shaft, providing a direct or indirect electrical contact, or with said at least one nonconductive part or element, thus successively closing and, respectively, opening electrical circuit of the switch.

The platen roller is usually made of a metallic shaft, so a conductive material, over which a rubber material is molded and rectified to get a precise geometrical cylinder shape which is to be pressed against the thermal printhead. Thus, by rubber being nonconductive, the platen roller shaft is isolated along almost its entire length except for its two opposite free ends. Providing two corresponding lateral contacts on the printer chassis able to contact with the free ends of the platen roller conductive shaft and an electrical current allows detecting the presence of the platen roller in the printing position. In such arrangement the platen roller conductive shaft behaves as an electrical switch.

Each end of both lateral conductive contacts is connected, by any known way from the prior art, to an electrical circuit, in order to transfer the electrical signal from the switch to a device capable to register said signal.

Preferably the motion means are not capable to rotate the platen roller against the thermal printhead when there is no paper in between. If the paper is not present, the motion means have no enough force to make the platen roller turn due to the high friction between the thermal head and the platen roller. Thus the presence or absence of the paper can be detected.

Advantageously, the platen roller is detachable from the printer in order to facilitate the loading of the paper and its positioning between the thermal printhead and the platen roller. In such arrangement the platen roller has two positions: first one called the printing position, where the platen roller is held in the printer chassis and allows the printer to print, and second one—called open position wherein the platen roller is detached from the printer chassis. Such arrangements of a thermal printing mechanism are well known in the prior art, and described for example in FR2786727.

According to another advantageous variant of the present invention at least one of the lateral conductive contacts is designed as pressure means for the conductive shaft so as to urge the platen roller against the thermal printhead. Preferably at least one of the lateral conductive contacts is in the form of conductive spring.

In this variant, the mechanical pressure that the lateral conductive contacts apply on the conductive shaft are requested to be high to get a good print quality, and this may lead to fast wearing of the lateral contacts or the conductive shaft when they are in direct contact with each other, since the friction between two metallic parts generates a high wearing. This is the reason why other electro-mechanical conductive elements may have to be inserted between the lateral conductive contacts and the conductive shaft's end so as to reduce the friction forces and to prevent from such wearing.

In one preferred modification of this variant one of the ends of the conductive shaft is rotatably inserted in a conductive bush so as to provide continuous electrical contact between the conductive shaft and inner surface of the conductive bush. The respective lateral contact having also a pressure means function is in contact with the outer surface of the bush when the platen roller is in printing position. Thus the lateral conductive contact presses the immobile bush instead of rotating conductive shaft. The mechanical wearing is then cancelled and the conductivity is still guaranteed during all the conductive shaft rotation, leading to an indirect continuous electrical contact between the lateral conductive contact and the conductive shaft.

Additionally a second other electro-mechanical element is inserted between the other shaft's end and the corresponding lateral conductive contact in order to generate at least one switch opening during one rotation of the conductive shaft. Such electro-mechanical element comprises at least one first non-conductive part, and at least one second conductive part to indirectly electrically connect the lateral conductive contact to the conductive shaft, the lateral contact being alternatively in contact with the said first non-conductive part or with the second conductive part during one rotation of the conductive shaft.

According to an advantageous variant of the present invention the second electro-mechanical element comprises a non conductive platen roller gear, inside which at least one additional conductive element is mounted. The non conductive platen roller gear is preferably made of plastic and comprises a cylindrical body on which there is a gear section and electro-mechanical contact section. The platen roller gear is fixedly mounted on the conductive shaft.

The at least one additional conductive element is positioned inside the cylindrical body of the non conductive platen roller gear in a direction substantially parallel to the conductive shaft and with one end is in continuous electrical contact with the conductive shaft, and other end of the additional conductive element is hardly protruding out through an opening arranged at the circumferential wall of the contact section of the platen roller gear in order to contact the lateral conductive contact when the conductive shaft is rotating. Preferably said at least one additional conductive element is flexible.

In such arrangement the at least one additional conductive element gets in electrical contact with the lateral conductive contact once per turn, and bends when the conductive lateral contact passes over it.

Then, the mechanical contact pressure between the flexible contact and the lateral conductive contact can be kept low because it is defined by the flexibility of the flexible additional conductive element and not by the pressure of the lateral conductive contact, which is in mechanical contact with the non conductive plastic gear, keeping under control the wearing as a result of the friction between two metallic conductive parts.

Preferably, a groove is designed in the contact part of the platen roller gear, to precisely laterally align the lateral conductive contact with the flexible contacts. Since the pressure means comprise wire springs, the contact surface between such wire spring and the cylindrical surface of the platen roller gear is one point, generating a very high pressure on it, thus increasing the wearing speed. The groove shape being complementary to the cross-section of the wire spring, it allows to have and half circle contact pressure arc between the platen roller gear and the wire spring drastically reducing the wearing speed.

As a consequence, and because the lateral conductive contact is a wire spring urging the platen roller against the thermal head via a cylindrical nonconductive plastic part, the mechanical wearing is very low.

It is clear that many variants can be done to generate the switch change state during the conductive shaft rotation, in particular, the type of flexible contacts which can be in different direction, shape or number, the lateral contacts which can be different from the pressure means and so having a wide variety of shapes and pressure, a direct contact with the conductive shaft assuming a low force conductive contact to limit the wearing, a slot in the conductive shaft with a complementary shape coming form the gear or any other non conductive additional part.

According to yet another variant of the present invention the printer chassis is conductive and at least one of the lateral conductive contacts is also in contact through its second end with the printer chassis.

According to yet another variant of the present invention at least one of the lateral conductive contacts is in contact trough its second end with a conductive pad located on a flexible circuit. Preferably the flexible circuit is in contact with one of the two lateral conductive contacts through the chassis.

Advantageously the flexible circuit is a single side flexible circuit and is folded on itself to generate a first contact pad and a second contact pad, the first contact pad being electrically connected to the second end of the lateral conductive contacts, and the second contact pad being electrically connected to the chassis.

Advantageously the flexible circuit has two terminals to transfer the signals from the switch to an electronic controller of the thermal printing mechanism.

Advantageously a first terminal on the terminal area of the flexible circuit, which is always connected to the chassis, whatever is the switch position, is connected to the ground on the electronic controller of the thermal printing mechanism.

The above disclosed configuration generates a switch opening sequence when the conductive shaft is rotating and directly or indirectly interacting with one of the lateral conductive contacts. Since the mechanical rotation of such conductive shaft is controlled by a stepper motor, there is a correspondence between the number of steps done by the stepper motor and the duty cycle of the open and close switch pulse sequence. Checking the coherency of this correspondence, it is possible to detect a loss in the motor steps due to any mechanical problem in the thermal printer mechanism. Such problems generally arise when there is a bad paper guiding or a paper jam somewhere in the printer leading generally to a print compression.

The advantage of the solution according to the present invention is that using usual parts of the construction provides a reliable sensor for detecting the printer availability to print. The sensor according to the present invention can implement a triple sensing function: paper presence, paper jam, and platen roller position in case the platen roller is removable. This solution allows avoiding the optical sensor for paper presence detection thus simplifying the construction and reducing the production costs.

BRIEF DESCRIPTION OF THE DRAWINGS

The characteristics of the invention will be disclosed in details in the following description of preferred embodiments, given as non-restrictive examples, with reference to the attached drawings wherein.

DETAILED DESCRIPTION OF PREFERRED EMBODIMENTS

Figure 1:
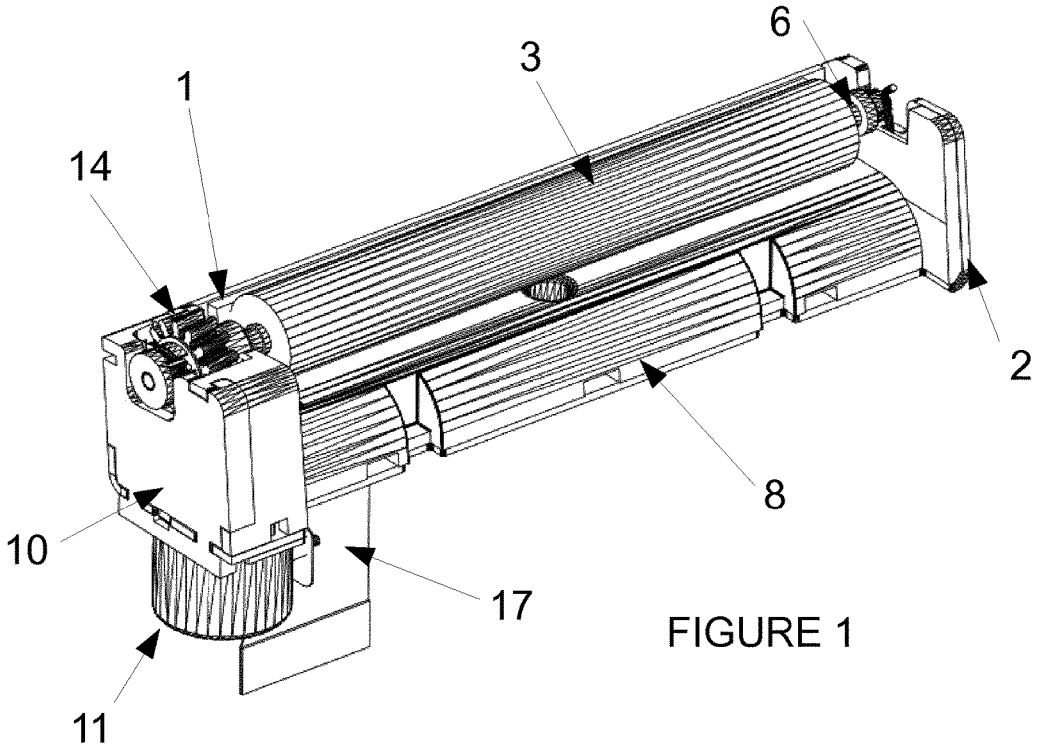
FIG. 1 is a schematic perspective view of the thermal printing mechanism according to the present invention.

FIG. 1 schematically shows the thermal printing mechanism according to the present invention. The thermal printing mechanism comprises a printer chassis 2; a thermal printhead 1; a platen roller 3 having a conductive shaft 6; a motion means 11 to put the platen roller 3 in rotation trough a platen roller gear 14 fixedly mounted on one end of the platen roller conductive shaft 6, a paper guide 8 and a gear train protector 10. Preferably the paper guide 8 and the gear train protector 10 are nonconductive.

Figure 2:
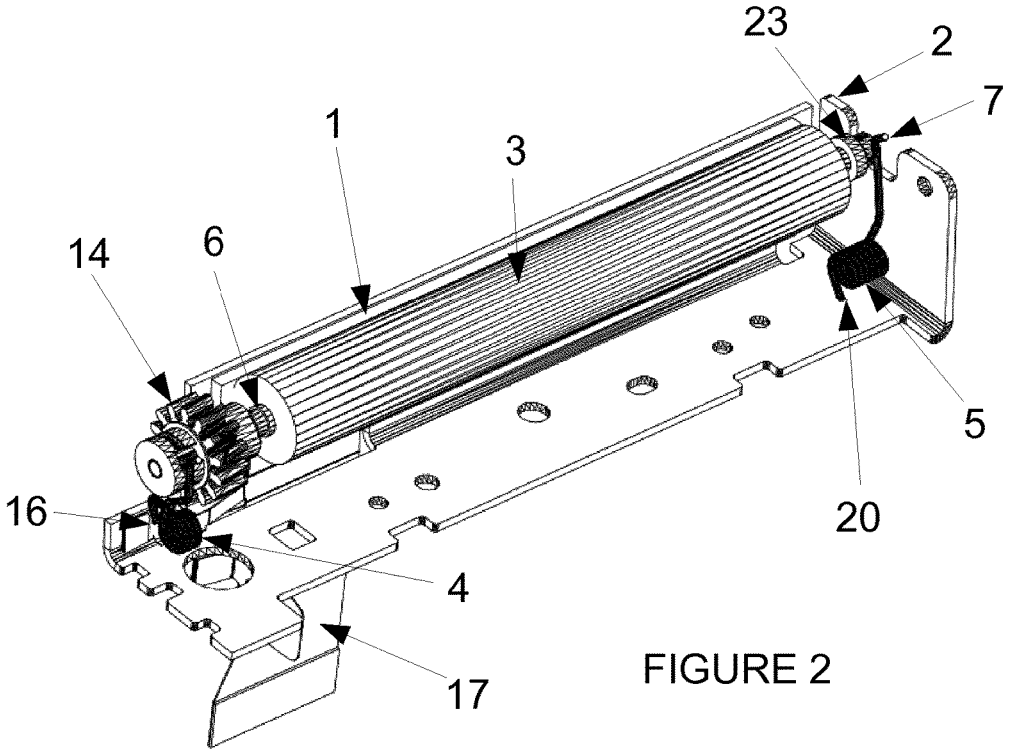
FIG. 2 is a schematic perspective view of the inner part of a preferred embodiment of the thermal printing mechanism according to the present invention.

FIG. 2 shows the inner part of a preferred embodiment of the thermal printing mechanism according to the present invention. The thermal printhead 1 is fixedly mounted on the conductive printer chassis 2. In alternative variants the thermal printhead can also be assembled in a known way on a rotative support.

The thermal printing mechanism further comprises two lateral conductive contacts 4 and 5 arranged on the printer chassis 2 so as to be in a contact with the two opposite ends of the platen roller conductive shaft 6 in the printing position of the platen roller 3 for conducting electrical current, thus forming an electrical switch for indication of the status of the platen roller position.

In the embodiment shown of the figures the platen roller 3 is movable between two possible positions—open position and printing position. The lateral conductive contacts 4 and 5 in this embodiment are also pressure means for the platen roller and comprise wire spring that have an angled shape part 7 at first end that interacts with conductive shaft 6, said angled shape part 7 is provided in order to create a hard point when the platen roller 4 moves from the open position to the printing position and vice-versa.

According to the present invention at one of the ends of the platen roller conductive shaft 6, that interacts with one of the lateral conductive contacts 4 or 5, there is at least one nonconductive part that is integral with said one end of the conductive shaft 6 or there is at least one nonconductive element fixedly mounted on said one end of the conductive shaft 6. Said at least one non conductive part or said at least one nonconductive element being arranged at contact area of said one end of the conductive shaft 6 with respective lateral conductive contact, wherein said at least one nonconductive part or element generates at least one open switch pulse during one full rotation of the platen roller conductive shaft 6. Such arrangement assures that during rotation of the platen roller 3 the respective lateral conductive contact 4 successively interacts with the conductive shaft 6, providing a direct or indirect electrical contact, or with the nonconductive part or element thus successively closing and, respectively, opening the electrical circuit of the switch.

Figure 3:
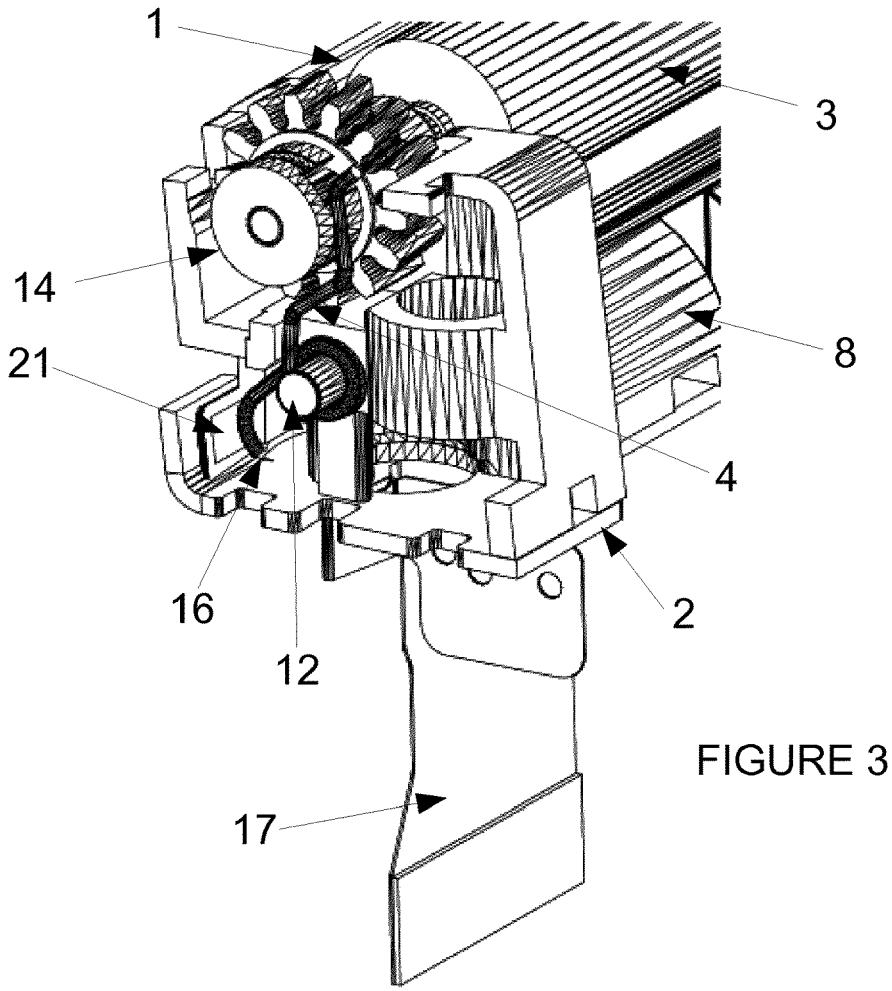
FIG. 3 is a schematic detail view of the pressure means and related electrical connections on the motion means side of the thermal printing mechanism.
Figure 4:
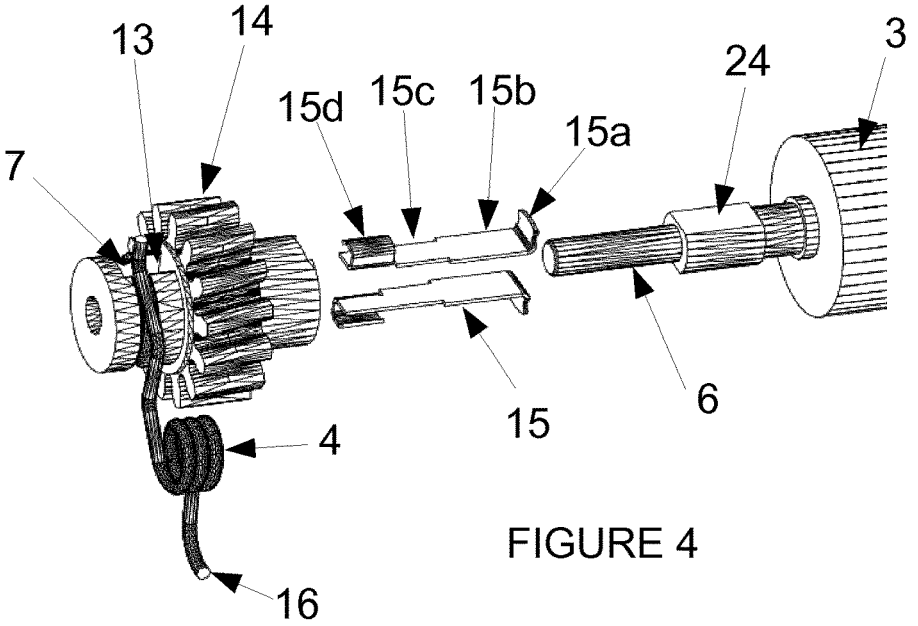
FIG. 4 is a schematic partly exploded view of a variant where the non conductive part is constituted by the platen roller gear mounted on the conductive shaft and additional conductive elements mounted on the platen roller gear are indirectly and periodically electrically connecting the lateral conductive contact to the conductive shaft.
Figure 5:
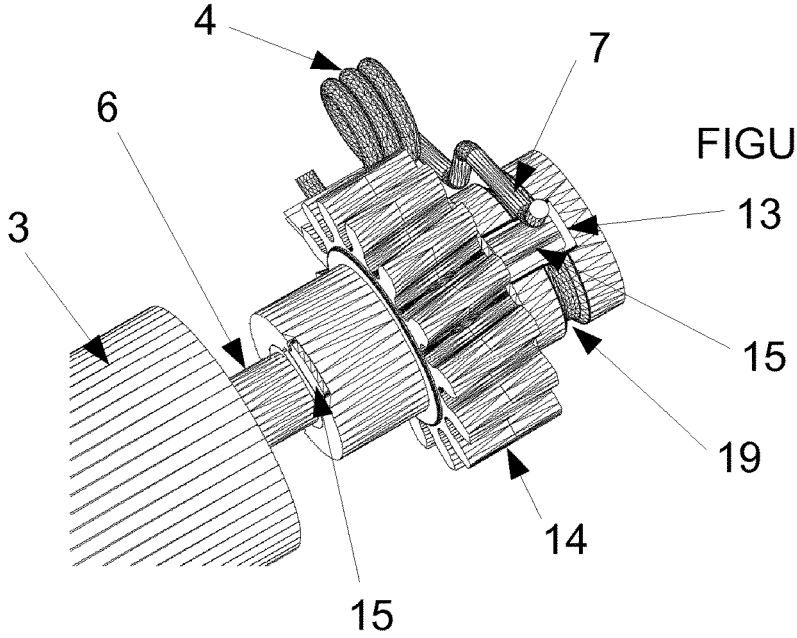
FIG. 5 is a schematic detail view of the motion means side of a variant of the thermal printing mechanism showing the assembled platen roller gear with its conductive elements.

As could be seen from the FIGS. 3, 4 and 5, the non conductive element mounted on the conductive shaft comprises the nonconductive platen roller gear 14, fixedly mounted on the conductive shaft. The lateral conductive contact 4, being also a pressure means for the thermal printhead, is in continuous mechanical contact with the platen roller gear 14. The groove 19 guides laterally the lateral conductive contact 4 and reduces the wearing against the nonconductive platen roller gear 14, since the mechanical contact pressure is following a half circle instead of a single point.

In this variant, two flexible additional conductive elements 15 are inserted opposite to one another into the cylindrical body of the nonconductive platen roller gear 14. Each flexible conductive element 15, for example, has four sections with different function. First section 15*a* is arranged perpendicular to the conductive shaft 6 to ease the mounting of the flexible conductive elements 15 into the platen roller gear 14, before the assembly of the platen roller gear 14 with the flexible conductive elements 15 into the conductive shaft 6. Second section 15*b* is arranged parallel to and is in continuous electrical contact with the conductive shaft 6 through a surface 24 arranged on the conductive shaft 6. Third section 15*c* has a reduced width to be flexible, so as to allow the flexible conductive element 15 to bend when the lateral conductive contact 4 pushes it. Finally the last forth section 15*d* has a hook-shaped protrusion in order to hardly protrude from an opening 13 (in the form of a slot as shown on the FIG. 4) arranged in circumferential wall of the cylindrical body of the platen roller gear 14, said forth section 15*d* is in intermittent electrical contact with the lateral conductive contact 4 during rotation of the conductive shaft 6.

In the above described variant, with two flexible additional conductive elements 15 arranged between two nonconductive parts of the platen roller gear 14, for one full rotation of the conductive shaft 6, the switch state generates four electrical transitions, and each closed switch state corresponds to a bending of the flexible conductive element 15. The mechanical force of this bending being defined by the flexible portion 15*c* of the flexible conductive element 15, thus the wearing of the hook-shaped protrusion 15*d* against the lateral conductive contact 4 is kept very low.

Although in the present embodiment there are two diametrically opposed additional conductive elements 15 mounted in the platen roller gear 14, to one skilled in the art will be clear that same functionality can be achieved with one, three or more conductive elements.

In the case the lateral conductive contact are different from the pressure means, it is also clear that a low force lateral conductive contact mounted on the chassis can be used, and the additional conductive elements may not need to be flexible, leading to a simple conductive part continuously electrically connected to the conductive shaft 6.

In such variant the at least one nonconductive part or at least one nonconductive element mounted on at least one end of the conductive shaft 6, may be achieved also in a different way than using the platen roller gear 14 like by filling notches on the circumferential surface of the shaft with non conductive material, applying stripes of nonconductive coating on the circumferential surface of the shaft, creating a slot in the conductive shaft and filling it with non conductive material of a part of the platen roller gear 14, or by any other way that one skilled in the art could use.

Figure 6:
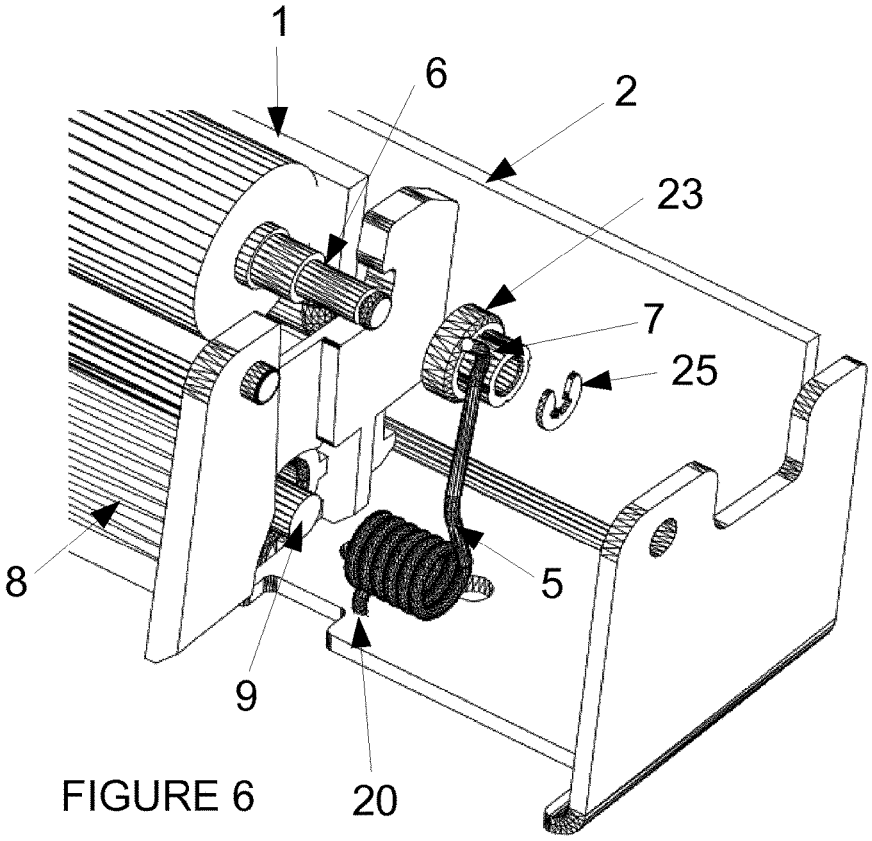
FIG. 6 is a schematic partly exploded detail view of the mounting of the lateral conductive contact in the form of a spring on the side opposite to the motion means, and the mounting of the indirect electrical connection through the bush.

The partly exploded view on the FIG. 6 shows the mounting of the spring 5 on a nonconductive shaft 9 mounted on the nonconductive paper guide 8. The conductive shaft 6 is rotatably inserted in additional conductive element comprising a conductive bush 23 so as to be in electrical contact with inner surface of the conductive bush 23. The lateral conductive contact 5 having also the pressure means function is in contact with the outer surface of the immobile conductive bush 23. A circlip 25 retains the conductive bush 23 on the conductive shaft 6.

The second end 20 of the spring 5 is in electrical and mechanical contact with the printer chassis 2.

Figure 7:
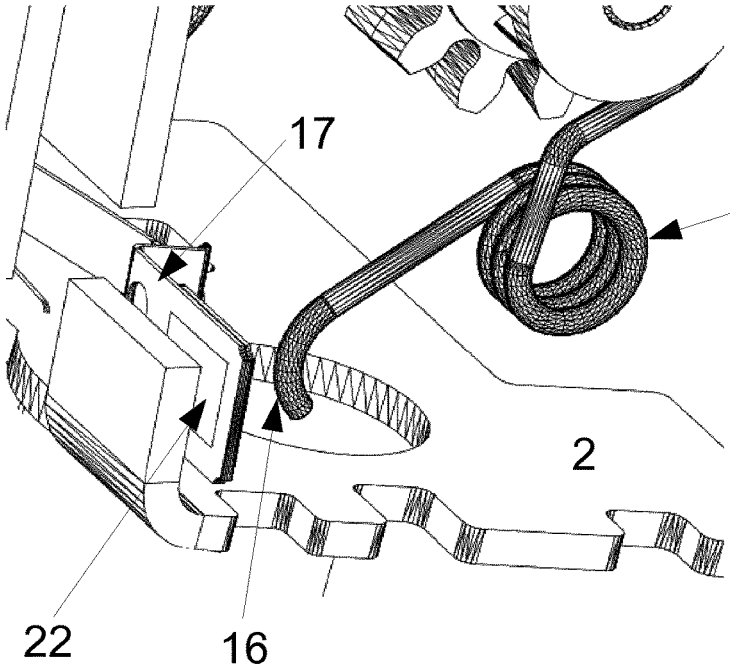
FIG. 7 is a partly exploded detail view of the assembly of the lateral conductive contact on the platen roller gear side with the flexible circuit on the printer chassis side.
Figure 8:
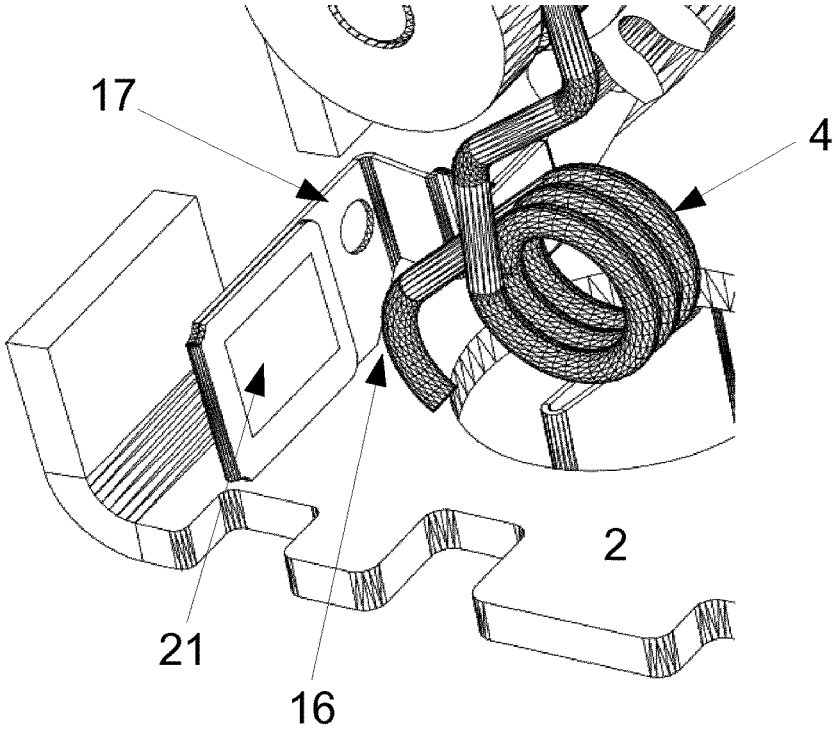
FIG. 8 is a partly exploded detail view of the assembly of the lateral conductive contact on the platen roller gear side with the flexible circuit on the lateral conductive contact side.

Preferably the thermal printing mechanism according to the invention comprises also a single side flexible circuit 17 with a first contact pad 21 and a second contact pad 22 as sown on FIGS. 7 and 8.

The elasticity of the wire spring 4, urges its second end 16 against the first contact pad 21 on the flexible circuit 17, thus urging the second contact pad 22 on the flexible circuit 17 against the printer chassis 2 as shown on FIGS. 3, 7 and 8.

Said wire spring 4 is mounted on a nonconductive shaft 12 arranged on a nonconductive paper guide 8 as shown on the FIG. 3. This allows the wire spring 4 to be electrically isolated from the printer chassis 2.

Both contact pads 21 and 22 of the flexible circuit 17 correspond to both ends of the electrical switch terminals located on a terminal area 18 of the flexible circuit 17.

Figure 9:
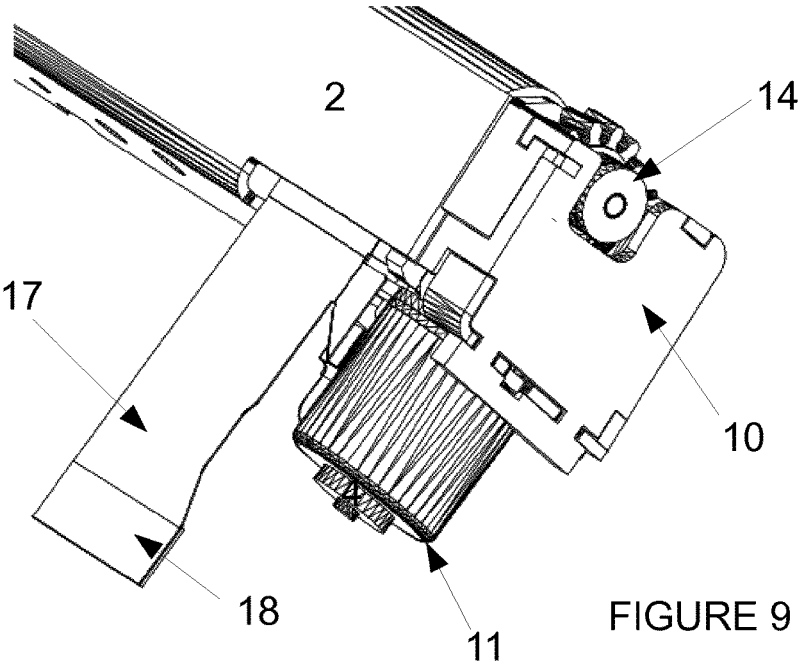
FIG. 9 is a detailed view of the flexible circuit and its terminal area.

FIG. 7 shows the second contact pad 22, and FIG. 8 shows the first contact pad 21. Finally two tracks on the flexible circuit 17, connect these two contacts to two corresponding terminals in the terminal area 18 of the flexible circuit 17 as shown on the FIG. 9.

Said terminals could be used directly to switch on a light like a LED. In a preferred embodiment, both terminals are connected to an electronic controller board which is processing the information coming from the switch, in order to control the printer operation.

Preferably said flexible circuit 17 is a single side flexible circuit, to keep its price low. Two conductive pad areas are made on the flexible circuit 17, in order to generate the first contact pad 21 and the second contact pad 22, both contacts being one over the other, when the flexible circuit is folded on itself.

When the switch is closed, the electricity flows through the first terminal on the terminal area 18 of the flexible circuit 17, to the printer chassis 2 through the second contact pad 22, due to the pressure exerted by the extremity 16 of the wire spring 4, then to the extremity 20 of the wire spring 5, then to the platen roller conductive shaft 6 through the extremity 7 of the wire spring 5 and the conductive bush 23, and via the extremity 7 of the wire spring 4, to the first contact pad 21 and then to the second terminal on the terminal area 18 of the flexible circuit 17 thanks again to the pressure of the extremity 16 of the wire spring 4, thus closing the switch circuitry.

In a preferred embodiment, the first terminal on the terminal area 18 of the flexible circuit 17, which is always connected to the printer chassis 2 via the second contact pad 22, and this, whatever is the status of the switch, is connected to the ground on the electronic board. Such connection allows to ground the printer chassis 2 for a better protection against electro-static discharge on the thermal printhead 1. The second terminal is then reflecting the status of the switch, being or not connected to ground according to the status of the switch.

Figure 10:
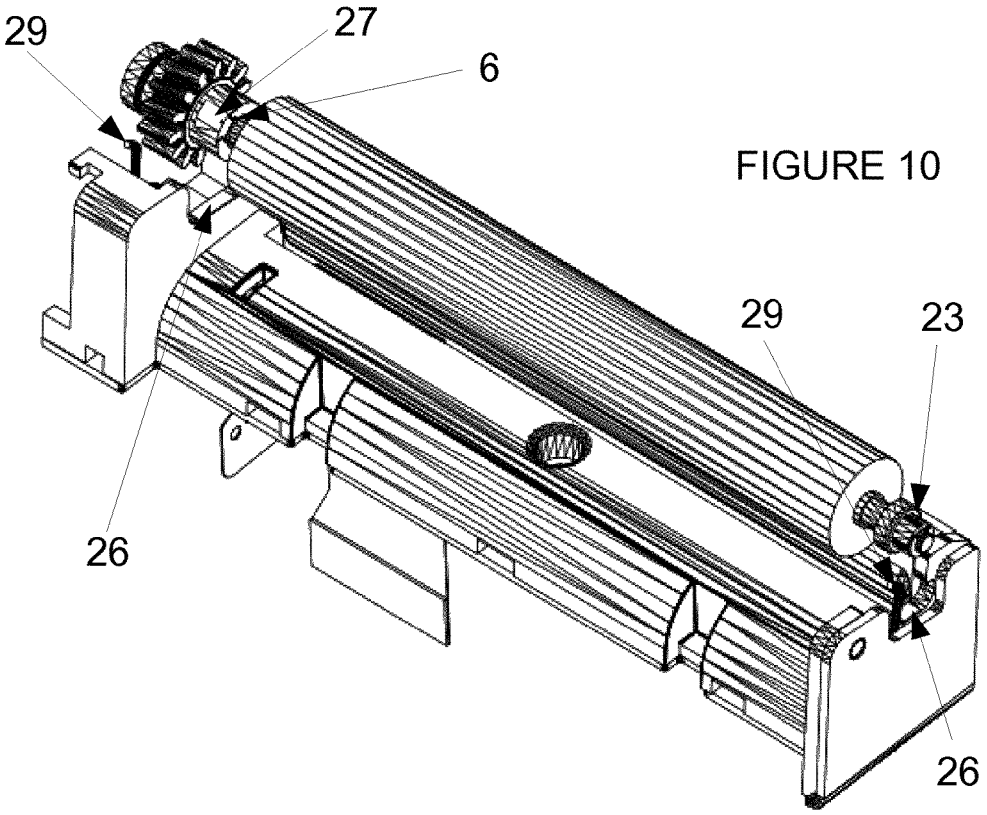
FIG. 10 is a schematic perspective view of another exemplary embodiment of the thermal printing mechanism according to the present invention, wherein the pressure means for the platen roller are not the lateral conductive contacts and are not flexible.

FIG. 10 is an embodiment where the pressure means 29 are different elements of the construction than the lateral conductive contacts 26. In general and not only in this variant, the function of the pressure means 29 is not only to urge the platen roller against the printhead, but also to align the platen roller to the dotline of the thermal printhead. To achieve this function, a small component of the force of the pressure means is used to urge the platen roller against two lateral alignment guides. The two lateral alignment guides comprise two horizontal portions of the non conductive paper guide arranged in a direction substantially perpendicular to the thermal printhead. The two lateral conductive contacts 26 are arranged on contact surfaces of said two lateral alignment guides with respective parts of the platen roller.

An additional conductive element 27 in continuous contact with the conductive shaft 6 is arranged on the platen roller gear 14 and generates a switch pulse when passing over the lateral conductive contact 26, every full rotation of the conductive shaft.

The conductive shaft 6 can be also in direct contact with the lateral conductive contact 26, thus in this embodiment the bush 23 has only the mechanical function to cancel the wearing between the pressure means 29 and the conductive shaft 6.

Such contacts do not need to be flexible since the components of the force of the pressure means in the direction perpendicular to these lateral conductive contacts can be kept low, and therefore such lateral conductive contacts can comprise just a conductive tape, plating or a thin metal plate in order to electrically contact directly or indirectly both ends of the conductive shaft. The further connection to the flexible circuit is not shown on this figure but can be easily realized by modifying the flexible circuit shape and creating pressure point with both lateral conductive contacts in order to insure the electrical continuity of the switch.

Figure 11:
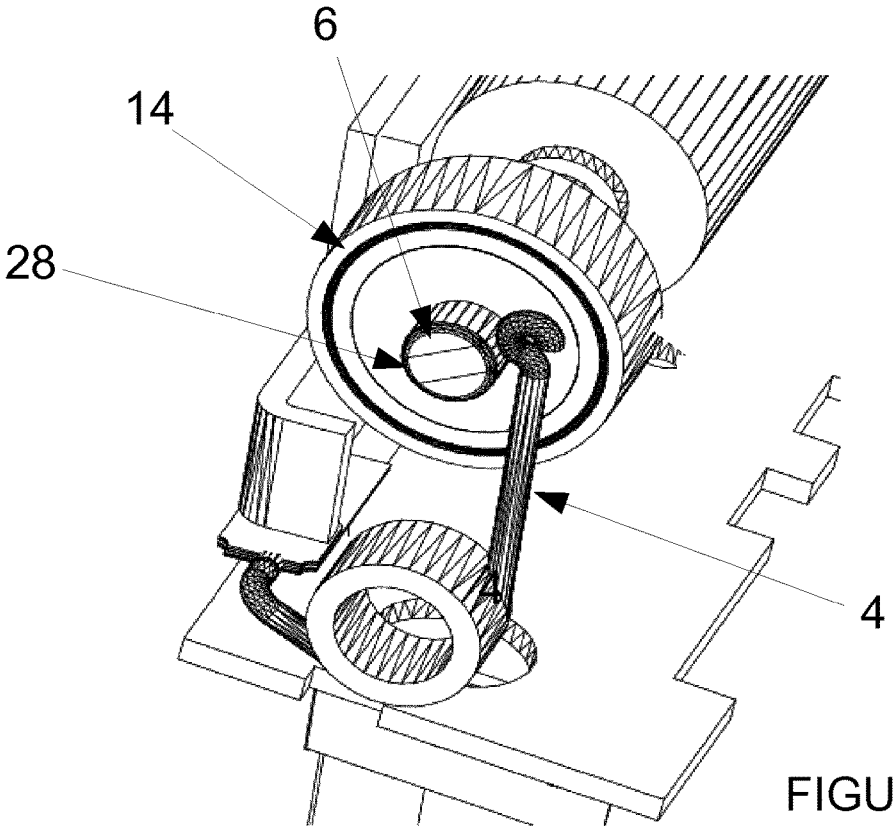
FIG. 11 is a schematic perspective view of yet another exemplary embodiment of the thermal printing mechanism according to the present invention, wherein the conductive shaft is in direct contact with the lateral conductive contacts.

FIG. 11, shows another embodiment of direct contact between the conductive shaft 6 and the lateral conductive contact 4, at the platen roller gear side. In this variant the conductive shaft 6 has a slot 28 which is filled by a complementary nonconductive blade which is a part of the platen roller gear 14. Optionally the lateral conductive contact 4, which is flexible, can be simultaneously a pressure means.

These two above example embodiments illustrate the numerous possibilities to realize the same function, with the use of flexible or not lateral conductive contacts, and direct or indirect electrical connection with the conductive shaft.

FUNCTIONING OF THE INVENTION

The information given by the open and closed position of the switch according to the invention can be analyzed by the printer driver software as follows:

When the printer has to print, the switch position is tested.

If the switch is initially closed, the lateral conductive contact 4 is in direct or indirect electrical contact with the platen roller shaft 6. And in the case the platen roller is detachable, said platen roller is in printing position.

Then the platen roller motion means 11 tries to rotate the platen roller 3 up to the position when the switch opens, but for a limited angle corresponding to the angular distance for one of the lateral contact to pass over at least one nonconductive part of or at least one nonconductive element mounted on one end of the conductive shaft 6.

If the switch gets open, there is paper since the platen roller 3 can turn freely. Paper can be fed backward to the original position in order not to loose paper and the printing can start.

If the switch remains closed, there is no paper.

If the switch is initially open, the lateral conductive contact 4 is not in direct or indirect electrical contact with the platen roller shaft 6, or the platen roller 3 is not in printing position in the case the platen roller is detachable.

Then the platen roller motion means 11 tries to rotate the platen roller 3 up to the position when the switch closes, but for a limited angle corresponding to the angular distance for one of the lateral conductive contact 4 to get in direct or indirect electrical contact with the platen roller shaft 6

If the switch gets closed, there is paper since the platen roller can turn freely. Paper can be fed backward to the original position in order not to loose paper and the printing can start.

If the switch remains open, there is no paper or the platen roller is not in printing position in the case the platen roller is detachable or there is a paper jam since the motor cannot nm freely in that case.

During the printing process, the synchronicity between the stepper motor steps and the switch open and close sequence is continuously checked and as soon as the synchronicity is lost, there is a paper jam, paper end, or the platen roller is not any more in the printing position in the case the platen roller is detachable.

With this very simple open and close switch sequence a triple sensing function is achieved: paper presence, paper jam, and platen roller position in case the platen roller is detachable.

By the present invention, the optical sensor usually used to sense the paper presence can be avoided, and replaced by the multifunctional detection system according to the present invention.

Various modifications and/or additions of parts will be apparent to those skilled in the art that will remain within the field and scope of the present invention defined in appended claims. All the parts may further be replaced with other technically equivalent elements.

Reference signs for technical features are included in the claims for the sole purpose of increasing the intelligibility of the claims and accordingly, such reference signs do not have any limiting effect on the interpretation of each element identified by way of example by such reference signs.

The invention claimed is:

1. A thermal printing mechanism comprising:

a printer chassis, a thermal printhead, a platen roller having a conductive shaft, a motion means to put the platen roller in rotation trough a platen roller gear fixedly mounted on one end of the platen roller conductive shaft, two lateral conductive contacts arranged on the printer chassis so as to be directly or indirectly in electrical contact with two opposite ends of the platen roller conductive shaft for conducting of electrical current, thus forming an electrical switch, characterized in that on one of the ends of the conductive shaft interacting with one of the lateral conductive contacts there is at least one nonconductive part that is integral with said one end of the conductive shaft (6) or there is at least one nonconductive element fixedly mounted on said one end of the conductive shaft, said at least one non conductive part or said at least one nonconductive element being arranged at contact area of said one end of the conductive shaft so as that during rotation of the platen roller the respective lateral conductive contact being able to successively interact with the conductive part of said end of the shaft, providing a direct or indirect electrical contact, or with said at least one nonconductive part or element, thus successively closing and, respectively, opening electrical circuit of the switch.

2. The thermal printing mechanism according to claim 1 wherein the motion means is not capable to rotate the platen roller against the thermal printhead when there is no paper in between.

3. The thermal printing mechanism according to claim 1 wherein the platen roller is detachable from the printer chassis and movable between two possible positions, a first printing position where the platen roller is held in the printer chassis and allows the thermal printing mechanism to print, and a second open position where the platen roller is detached from the printer chassis.

4. The thermal printing mechanism according to claim 1 wherein said nonconductive element comprises a nonconductive part of the platen roller gear that is mounted on one end of the conductive shaft.

5. The thermal printing mechanism according to claim 1 wherein between at least one of the ends of the conductive shaft and one lateral conductive contact at least one additional conductive element is arranged for indirect conduction of electrical current between the conductive shaft and said lateral conductive contact, said at least one additional conductive element being designed so as to eliminate the friction forces between the lateral conductive contact and the conductive shaft in rotation.

6. The thermal printing mechanism according to claim 5, wherein said additional conductive element comprises a conductive bush rotatably mounted on at least one end of the conductive shaft so as to provide electrical contact between the conductive shaft and inner surface of the conductive bush, wherein the respective lateral conductive contact is arranged so as to be in electrical contact with outer surface of the conductive bush.

7. The thermal printing mechanism according to claim 1 wherein at least one of the lateral conductive contacts is in the form of a conductive spring.

8. The thermal printing mechanism according to claim 1 wherein at least one of the lateral conductive contacts is designed as a pressure means for the conductive shaft so as to urge the platen roller against the thermal printhead.

9. The thermal printing mechanism according to the claim 8, wherein one lateral conductive contact is in continuous mechanical contact with the nonconductive platen roller gear for urging the platen roller against the thermal printhead, and said lateral conductive contact is in intermittent electrical contact with at least one additional conductive element arranged in the nonconductive platen roller gear so as to be in continuous electrical contact with the conductive shaft.

10. The thermal printing mechanism according to claim 9 wherein said at least one additional conductive element is flexible and is positioned inside a cylindrical body of the nonconductive platen roller gear, having one end being in continuous electrical contact with the conductive shaft, and other end arranged so as to protrude through a respective opening arranged in circumferential wall of said cylindrical body of the nonconductive platen roller gear and to bend when in intermittent electrical contact with respective lateral conductive contact during rotation of the conductive shaft.

11. The thermal printing mechanism according to claim 1 wherein the printer chassis is conductive and at least one of the lateral conductive contacts, is also in contact through its second end with the printer chassis.

12. The thermal printing mechanism according to claim 1 wherein at least one of the lateral conductive contacts is in contact through its second end with a conductive pad located on a flexible circuit.

13. The thermal printing mechanism according to claim 12 wherein the flexible circuit is in contact with one of the two lateral conductive contacts through the printer chassis.

14. The thermal printing mechanism according to claim 12, wherein the flexible circuit is a single side flexible circuit and is folded on itself to generate a first contact pad and a second contact pad, the first contact pad being electrically connected to the second end of the lateral conductive contact (4 or 5), and the second contact pad being electrically connected to the printer chassis.

15. The thermal printing mechanism according to claim 12 wherein the flexible circuit has two terminals in a flexible circuit terminal area to transfer the signals from the switch to an electronic controller of the thermal printing mechanism and wherein a first terminal on the terminal area of the flexible circuit, which is always connected to the printer chassis, in all positions of the switch, is connected to the ground on the electronic controller of the thermal printing mechanism.

* * * * *